United States Patent [19]

Hamy et al.

[11] Patent Number: 4,559,723

[45] Date of Patent: Dec. 24, 1985

[54] SPORTS SHOE

[75] Inventors: Norbert Hamy; Phillip Nutt; Douglas Sheridan, all of Toronto, Canada

[73] Assignee: Bata Shoe Company, Inc., Belcamp, Md.

[21] Appl. No.: 568,390

[22] Filed: Jan. 5, 1984

[30] Foreign Application Priority Data

Jan. 17, 1983 [CA] Canada ..... 419619

[51] Int. Cl.[4] ..... A43B 1/10

[52] U.S. Cl. ..... 36/102; 36/114; 36/30 R; 36/59 C; 36/50; D2/309

[58] Field of Search ..... 36/50, 102, 103, 104, 36/114, 30 R, 59 C, 45; D2/274, 275, 310

[56] References Cited

U.S. PATENT DOCUMENTS

| | | | |
|---|---|---|---|
| D. 133,638 | 9/1942 | Arnoff | D2/274 |
| D. 262,582 | 1/1982 | Moore | D2/310 |
| 2,643,469 | 6/1953 | Herceg | 36/50 X |
| 3,138,880 | 6/1964 | Kunzli | 36/114 |
| 4,045,888 | 9/1977 | Oxenberg | 36/114 |
| 4,255,876 | 3/1981 | Johnson | 36/45 X |
| 4,393,605 | 7/1983 | Spreng | 36/114 |
| 4,413,431 | 11/1983 | Cavanagh | 36/114 |
| 4,449,306 | 5/1984 | Cavanagh | 36/30 R |
| 4,449,307 | 5/1984 | Stubblefield | 36/114 X |
| 4,454,662 | 6/1984 | Stubblefield | 36/102 X |

FOREIGN PATENT DOCUMENTS

| | | | |
|---|---|---|---|
| 252763 | 3/1967 | Austria | 36/50 |
| 230482 | 4/1944 | Switzerland | 36/50 |

*Primary Examiner*—Werner H. Schroeder
*Assistant Examiner*—T. G. Graveline
*Attorney, Agent, or Firm*—Holman & Stern

[57] ABSTRACT

The invention provides a sports shoe comprising a sole, and an upper having flaps with opposed edges adapted to be drawn together over the instep of the wearer with a shoelace, said opposed edges substantially meeting in a region extending from the leg opening of the shoe towards the toe to a point where they part to define an aperture extending across the shoe to impart increased flexibility to the toe region.

16 Claims, 8 Drawing Figures

FIG. 4
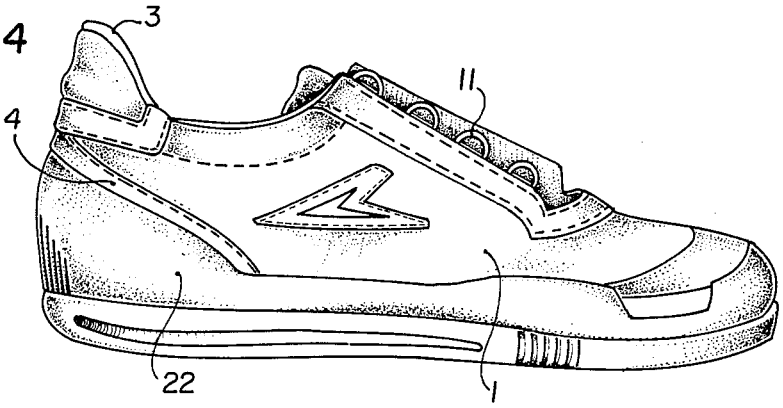
FIG. 5
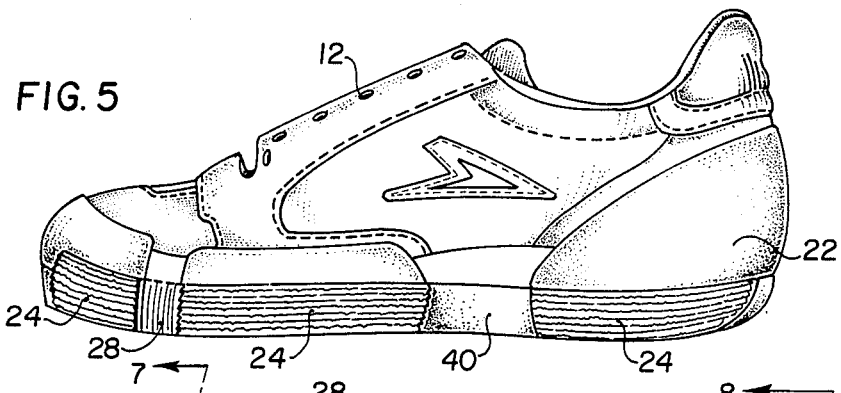
FIG. 6
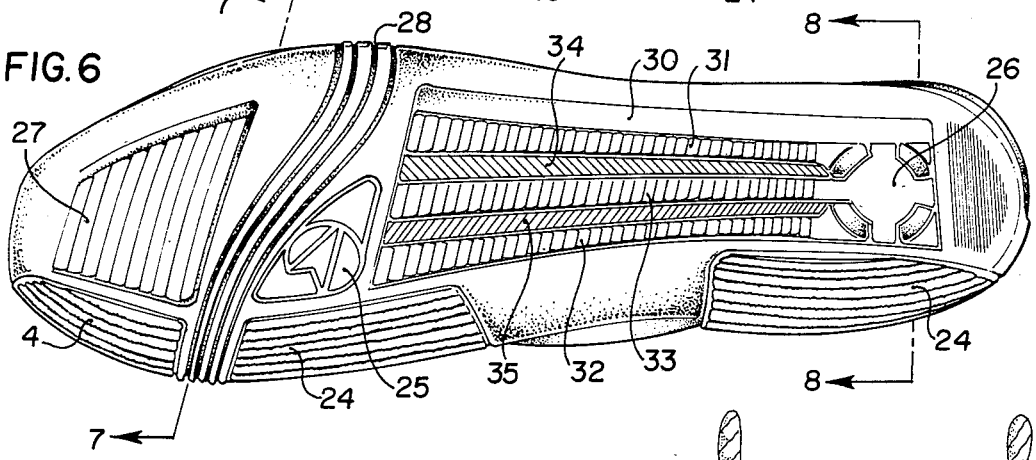
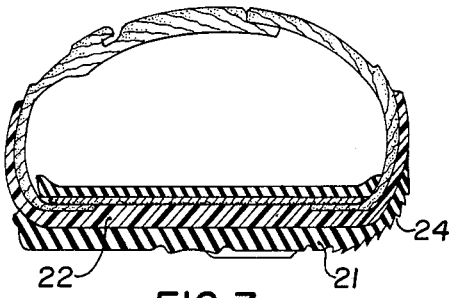
FIG. 7
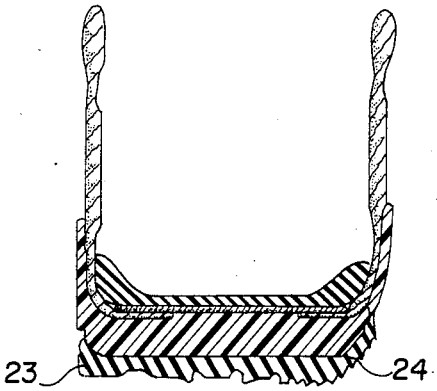
FIG. 8

SPORTS SHOE

This invention relates to a sports shoe and especially a squash shoe.

Shorts shoes, such as tennis shoes have of course been known for a long time, but these prior art sports shoes do not always lend themselves well to the high degree of manoeuverability required of the squash player.

An object of the invention is to provide an improved sports shoe particularly suited for playing squash.

According to the present invention there is provided a sports shoe comprising a sole, and an upper having flaps with opposed edges adapted to be drawn together over the instep of the wearer with a shoelace, said opposed edges when drawn together substantially meeting along a line extending from the leg opening of the shoe towards the toe to a point where they part to define an elongate aperture asymmetrically disposed with respect to a centre line of the shoe and extending at an oblique angle to said centre line in a generally transverse direction so as to follow the metatarsal flex path of the wearer and thereby improve the flexibility and comfort of the shoe.

The aperture preferably extends at an angle to the toe-heel axis, being nearer the toe on the inner side of the shoe. The shoelace may also extend across the aperture region. In a preferred embodiment the opposed edges are bordered on the upper by a band of reinforcing material, preferably leather. A tongue extends under the flaps of an aperture, being sewn along one edge only under one of the flaps for ease of putting on.

One flap desirably has spaced D-rings attached thereto with eyeletts being provided on the other. This arrangement increases the speed of putting on and removal of the shoe.

The invention will now be described by way of example only, with reference to the accompanying drawings, in which:

FIG. 4 is a view of the squash shoe from one side;

FIG. 5 is a view of the squash shoe from the other side;

FIG. 6 is an underneath view showing details of the sole;

FIG. 7 is a section along lines 7—7 in FIG. 6; and

FIG. 8 is a section along lines 8—8 of FIG. 6.

Figure 1:
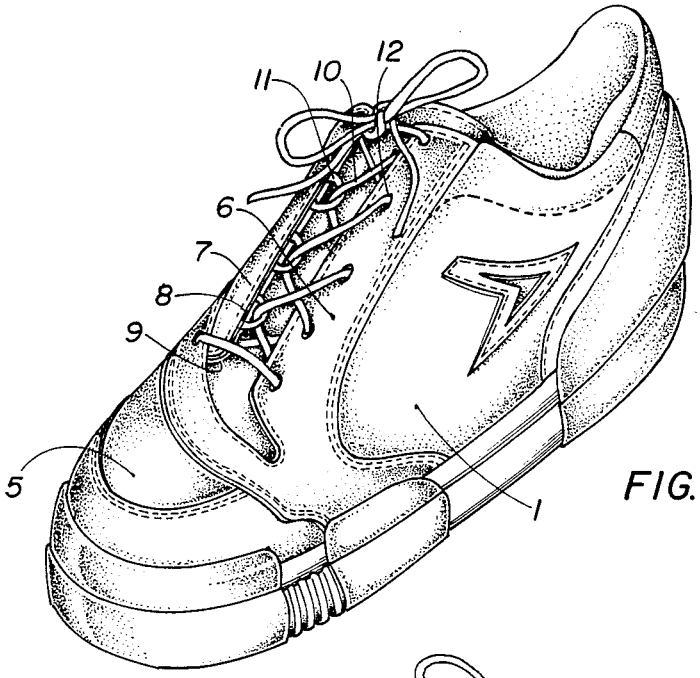
FIG. 1 is a front perspective view of a squash shoe in accordance with the invention.

The squash shoe shown in the drawings has an upper 1 of porous material to allow the foot of the wearer to breathe. The periphery 2 of the leg aperture is padded and has a raised heel portion 3 to support the back of the leg. The upper is covered over the heel region by a leather counter 4, and a protective leather covering 5 also extends around the edges of the shoe and over the toe.

Figure 3:
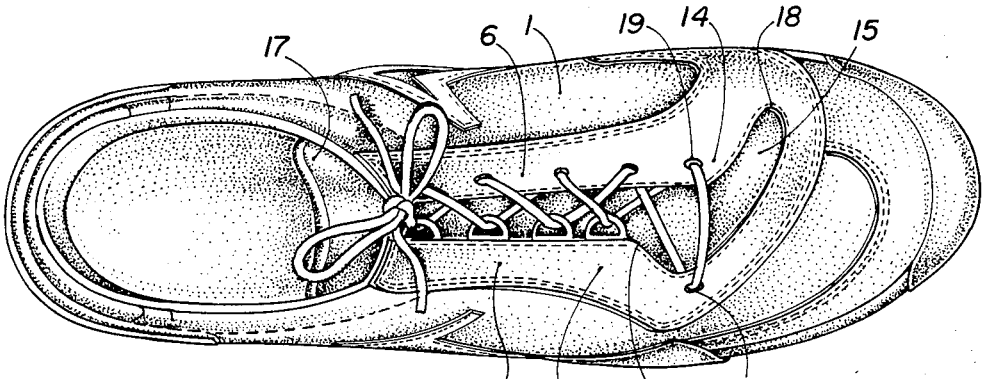
FIG. 3 is a plan view of the squash shoe.

The upper has two flaps 6 and 7 defining opposed edges 8 and 9 adapted to be drawn together by a shoelace 10. D-rings 11 are spaced along the flap 7, whereas the flap 6 is provided with eyelets 12 to receive the shoelace. As shown more clearly in FIG. 3, the opposed edges of the flaps 6 and 7 run substantially parallel to each other over the instep of the wearer from the leg aperture to a point 13 displaced towards the toe of the shoe. Over this region the two flaps may be drawn together by the shoelace so that they substantially meet.

Beyond the point 13 the flap 7 is cut away towards the side of the shoe and beyond point 14 on the other flap a cut is made towards the side of the shoe so as to define a curved aperture 15 extending at an incline to the heel/toe axis of the shoe so as to follow the metatarsal bones flex path. The aperture 15 is generally elongate and the end on the inside of the shoe lies nearer the toe. Underneath the flaps 6 and 7 is provided a padded tongue 17 which is stitched to the upper at one edge only along a line extending to point 18 at the leading end of the aperture 15. The tongue 17 is therefore hinged along one edge. The tongue 17 is generally rectangular in shape, although the edge nearest the toe follows the contour of the aperture 15. It may however be desired for production reasons to hinge the tongue 17 at its base.

The provision of D-rings on one flap and eyelets on the other makes the shoe very convenient to put on, as does the tongue 17 which is only hinged on one side. An important feature of this part of the shoe is the aperture 15, which is so designed as to impart additional flexibility to the shoe in the precisely right direction to conform to the flexing of the foot during vigorous exercise, particularly during a game of squash. In the aperture the foot is only covered by the tongue 17, and the shoe thus has excellent flexibility with respect to pivotal movement about the toes.

The flaps are preferably drawn together around the aperture 15 by means of additional eyelets 19. The opposed edges 8 and 9 of the flaps 6 and 7 and the aperture 15 itself are surrounded by leather band 20 acting as a reinforcing material without effecting the flexibility of the shoe in the critical region as defined by the aperture 15. This whole structure forms what is known as a flexible eyestay. The flexible eyestay structure has been shown to have very significant advantages, particularly when the shoe is used as a squash shoe.

The shoe has a rubber outsole 21 on top of which is placed a suitably shaped polyurethane midsole 22 to cushion the wearer against the sharp shocks encountered in a game of squash. The inside of the shoe is suitably padded and the overall construction makes the shoe very comfortable to wear.

Figure 2:
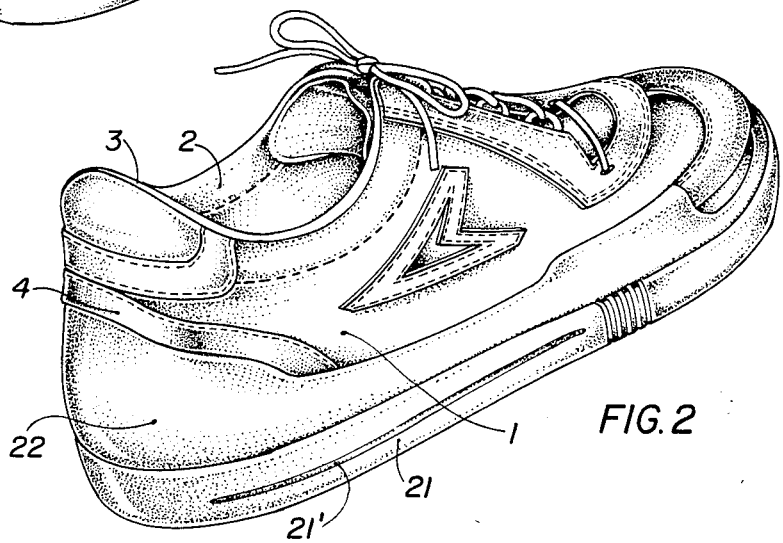
FIG. 2 is a rear perspective view of the squash shoe.

The design of the outsole 21, shown particularly in FIG. 6, 7 and 8 is also significant. At the rear of the sole on the outside is provided a cantilevered lip 23, (see FIG. 8), formed by a groove 21 (FIG. 2) extending in the side of the sole to the metatarsal region, which gives a cushion effect during a strike movement and provides additional stability. The outsole on the inside of the shoe has a curved, serrated edge region 24, extending up over the side of the sole, which provides good gripping power in a lateral lunge movement. The serrated edge is interrupted in the region 40 between the toe and heel. The bottom of the outsole is carefully configured to provide optimum performance. Two pivot points 25 and 26 are provided in the toe and heel regions of the shoe. Extra grip in the toe region is provided by serrations 27 forming sawteeth pointing towards the rear. Curved, castellated grooves 28 extending across the shoe under the aperture 15 provide increased flexibility in the sole in the critical region, where flexibility is most desired.

The central region 30 of the sole has two parallel serrated strips 31 and 32 having sawteeth pointing towards the toe. A central serrated strip 33 has sawteeth pointing towards the heel. Between the central strip 33 and outer strips 31 and 32 are provided parallel strips 34 and 35 of castellations lying at an angle of approximately 45 degrees to the heel/toe axis of the shoe. The region 30 provides particularly good antiskid resistance in all directions while at the same time retaining good flexibility in the outsole.

The flex path and eye-stay system described is applicable to most sports, although the sole is particularly application to court sports, such as squash.

The embodiments of the invention in which an exclusive property or privilege is claimed are defined as follows:

1. A sports shoe comprising a sole, and an upper having flaps with opposed edges adapted to be drawn together over the instep of the wearer with a shoelace, said opposed edges when drawn together substantially meeting along a line extending from the leg opening of the shoe towards the toe to a point where said edges part to define an elongate aperture asymmetrically disposed with respect to a centre line of the shoe and extending at an oblique angle to said centre line in a generally transverse direction so as to follow the metatarsal flex path of the wearer and thereby improve the flexibility and comfort of the shoe.

2. A sports shoe according to claim 1, wherein said edges are surrounded on the upper by a band of reinforcing material forming an eyestay.

3. A sports shoe according to claim 2, wherein a plurality of spaced D-rings are provided on one of said flaps for receiving the shoelace, and a plurality of cooperating spaced eyelets are provided in the other flap for receiving the shoelace, whereby the shoelace passes through eyelets on one flap and D-rings on the other.

4. A sports shoe according to claim 3, wherein the shoelace also extends across the aperture to draw opposed edges thereof towards each other.

5. A sports shoe according to claim 1, wherein the sole of the shoe has grooves extending thereacross in the region underneath the aperture and following the metatarsal flex path to provide additional flex.

6. A sports shoe according to claim 5, wherein said grooves curve rearwardly as they extend from the inside to the outside of the shoe.

7. A sports shoe according to claim 6, wherein said grooves have a castellated appearance.

8. A sports shoe according to claim 5, wherein an edge of the sole (in the heel region) on the outer side of the shoe is provided with a cantilevered tip formed by a groove extending from the heel to the metatarsal region to give a cushion effect when said edge strikes the ground and provide(s) lateral stability.

9. A sports shoe according to claim 5, wherein the inner edge of the sole, at least in the heel and toe regions, is curved and serrated to provide good grip when the sole strikes the ground at an angle.

10. A sports shoe according to claim 5, further comprising a midsole giving an additional cushioning effect.

11. A sports shoe according to claim 10, wherein said midsole is made of polyurethane.

12. A sports shoe according to claim 5, wherein the sole is provided with pivot points in the toe and heel regions respectively.

13. A sports shoe according to claim 5, wherein a serrated region with sawteeth pointing towards the heel is provided in the toe region of the sole to improve the grip.

14. A spots shoe accroding to claim 5, wherein a central region of the sole comprises a plurality of parallel strips extending generally along the toe heel axis of the shoe.

15. A sports shoe according to claim 14, wherein said strips comprise two outer strips of serrations having sawteeth pointing towards the toe and an inner strip having serrations pointing towards the heel.

16. A sports shoe comprising a sole, and an upper having flaps with opposed edges adapted to be drawn together over the instep of the wearer with a shoelace, said opposed edges substantially meeting in a region, extending from the leg opening of the shoe towards the toe to a point where said edges part to define an elongate aperture extending in a generally transverse direction to impart increased flexibility to the shoe, where the sole of the shoe has grooves extending there across in the region underneath the aperture to provide additional flex, a central region of the sole comprises a plurality of parallel strips extending generally along the toe heel axis of the shoe, said strips comprising two outer strips of serrations having sawteeth pointing towards the toe and an inner strip having serrations pointing towards the heel, and the sole centreline of the shoe.

* * * * *